US010597593B2

(12) United States Patent
Poulsen et al.

(10) Patent No.: US 10,597,593 B2
(45) Date of Patent: Mar. 24, 2020

(54) PROCESS FOR HYDROTREATMENT OF A FUEL GAS STREAM CONTAINING MORE THAN 4% OLEFINS

(71) Applicant: Haldor Topsøe A/S, Kgs. Lyngby (DK)

(72) Inventors: Jens Michael Poulsen, Frederikssund (DK); Lene Boas, Kgs. Lyngby (DK); Max Thorhauge, Herlev (DK)

(73) Assignee: Haldor Topsoe A/S, Lyngby (DK)

( * ) Notice: Subject to any disclaimer, the term of this patent is extended or adjusted under 35 U.S.C. 154(b) by 0 days.

(21) Appl. No.: 16/301,539

(22) PCT Filed: Sep. 11, 2017

(86) PCT No.: PCT/EP2017/072721
§ 371 (c)(1),
(2) Date: Nov. 14, 2018

(87) PCT Pub. No.: WO2018/065174
PCT Pub. Date: Apr. 12, 2018

(65) Prior Publication Data

US 2019/0284489 A1 Sep. 19, 2019

(30) Foreign Application Priority Data

Oct. 7, 2016 (DK) ..... 2016 00604

(51) Int. Cl.
*C10G 70/02* (2006.01)
*C10G 45/00* (2006.01)

(52) U.S. Cl.
CPC ..... *C10G 70/02* (2013.01); *C10G 45/00* (2013.01); *C10G 2300/1088* (2013.01); *C10G 2300/201* (2013.01); *C10G 2300/4081* (2013.01)

(58) Field of Classification Search
CPC ..... C10G 70/02; C10G 2300/1088
See application file for complete search history.

(56) References Cited

U.S. PATENT DOCUMENTS

| | | | | |
|---|---|---|---|---|
| 4,864,067 | A | 9/1989 | Harandi et al. | |
| 5,670,116 | A | 9/1997 | Gupta et al. | |
| 6,514,403 | B1 | 2/2003 | Louie et al. | |
| 2002/0121459 | A1 | 9/2002 | Pradhan et al. | |
| 2003/0111386 | A1 | 6/2003 | Mukherjee et al. | |
| 2007/0012596 | A1 | 1/2007 | Picard et al. | |
| 2008/0237090 | A1 | 10/2008 | Musich et al. | |
| 2011/0031162 | A1 | 2/2011 | Drnevich et al. | |
| 2011/0034745 | A1 | 2/2011 | Raybold et al. | |
| 2011/0077437 | A1 | 3/2011 | Shah et al. | |
| 2012/0209041 | A1 | 8/2012 | Hanks et al. | |
| 2013/0030235 | A1* | 1/2013 | Von Trotha | C10G 65/00 585/809 |
| 2015/0152336 | A1 | 6/2015 | Greene | |
| 2015/0314282 | A1 | 11/2015 | Bhan et al. | |

FOREIGN PATENT DOCUMENTS

| | | | | |
|---|---|---|---|---|
| WO | WO 98/40449 | | 9/1998 | |
| WO | WO 2012/172065 | A1 | 12/2012 | |
| WO | WO-2012172065 | A1 * | 12/2012 | B01J 8/0242 |

* cited by examiner

*Primary Examiner* — Randy Boyer
(74) *Attorney, Agent, or Firm* — Blank Rome LLP

(57) ABSTRACT

A process for the hydrotreatment of a fuel gas stream containing up to 15% olefins comprises the steps of introducing the fuel gas stream into at least one co-current reactor, where the stream is split into two flow fractions, of which one fraction is routed through an olefin treatment section, while the other fraction is routed through another section, subjecting the sections to heat exchange, combining the two flows, thereby equalizing temperatures and compositions, cooling the combined flow over a heat exchanger and reacting the combined flow to equilibrium in an adiabatic hydrotreatment reactor. A second co-current reactor with intercooling arranged in series after the first cocurrent reactor and before the final adiabatic reactor is used if the fuel gas stream contains more than 8% olefins.

5 Claims, No Drawings

PROCESS FOR HYDROTREATMENT OF A FUEL GAS STREAM CONTAINING MORE THAN 4% OLEFINS

The present invention relates to a process for controlling the temperature increase of a reactor for refinery fuel gas hydrotreating. More specifically, the invention concerns a process for the hydrotreating of a refinery fuel gas with a content of olefins above 4%, said process being a once-through process without the use of an effluent recycle to control the heat.

Hydrotreating processes as such are known from the prior art. Thus, U.S. Pat. No. 4,864,067 discloses a process and a reactor system for subjecting a low sulfur-containing olefinic distillate and conventional feedstock to a catalytic hydrodesulfurization. The process comprises passing a minor part of the olefinic distillate to a first hydrotreating zone in admixture with conventional catalytic hydrodesulfurization (CHD) feedstock. The major part of the olefinic distillate is passed to a second hydrotreating zone in combination with the effluent from the first zone. In this manner, the exotherm attributable to hydrogenation of olefins is controlled within limits sufficient to avoid frequent catalyst regeneration.

In US 2002/0121459 A1, a product of reduced sulfur content is produced from an olefin-containing hydrocarbon feedstock which includes sulfur-containing impurities. The feedstock is contacted with an olefin-modificating catalyst in a reaction zone under conditions which are effective to produce an intermediate product having a reduced amount of olefinic unsaturation relative to that of the feedstock. The intermediate product is then separated into fractions of different volatility, and the lowest boiling fraction is contacted with a hydrodesulfurization (HDS) catalyst and hydrogen under conditions, which are effective to convert at least a part of its sulfur-containing impurities to $H_2S$.

In US 2007/0012596 A1, a process for hydrodesulfurizing an olefinic gasoline containing less than 0.1 wt % sulfur in at least one HDS reactor using a bimetallic catalyst at a temperature of 220-350° C. and a pressure of 0.1-5 MPa is disclosed. A fraction of the desulfurized gasoline is recycled to the inlet of the HDS reactor with a recycle ratio of 0.1 to 3 times the flow rate of the gasoline that is to be desulfurized.

A process for sulfur removal from refinery off-gas is disclosed in US 2011/0077437 A1, where organic sulfur compounds containing olefins are converted to hydrogen sulfides that are subsequently removed using conventional amine treating systems. The process uses a catalytic reactor with or without a hydrotreater depending on the olefin concentration of the off-gas stream.

US 2015/0314282 A1 describes a catalyst and its use for selectively desulfurizing sulfur compounds present in an olefin-containing hydrocarbon feedstock to very low levels with minimal olefin hydrogenation. The catalyst comprises an inorganic oxide substrate containing a Ni compound, a Mo compound and optionally a P compound that is overlaid with a Mo compound and a Co compound.

Refinery fuel gas streams are hydrotreated in order to remove olefins, especially diolefins, at least partially, by hydrogen saturation to the corresponding alkanes and also to hydro-desulfurize sulfur species to $H_2S$ for removal by amine wash or other $H_2S$-removing technologies. When the olefin level is above 4-5%, the exotherm causes a temperature increase beyond that which is technically feasible in an adiabatic reactor, given the constraints in inlet temperature (catalyst activity) and outlet temperature (catalyst degradation/deactivation).

So far, the most common solution to overcome an olefin level, which is too high, and a consequent excessive adiabatic temperature increase has been a recycle of downstream reacted effluent gas which—because it has reacted—is no longer reactive and solely functions as a heat sink. This recycle is expensive, both from a CAPEX and an OPEX perspective, and its complexity and mechanical compressor both have a negative impact on the overall reliability and availability.

It has now surprisingly turned out that a co-current reactor system, for instance as described by the Applicant in WO 2012/172065 A1, is very suitable for hydrotreating refinery fuel gases with an olefin level of 4 to 15%.

Co-current reactor systems specifically for use in connection with fuel gas hydrotreating are sparsely described in the prior art. While US 2015/0152336 A1 does disclose a co-current adiabatic reaction system, said system is intended for the conversion of feedstocks rich in triacylglycerides, which is far removed from the subject-matter of the present invention.

U.S. Pat. No. 6,514,403 relates to a hydrocracking and hydrotreating process for hydrocracking feedstock oils such as vacuum gas oil to produce diesel and lighter distillate products. A first hydrogenation process is carried out in a main reactor with the feedstock and hydrogen flowing co-currently down through a top section containing a layered system of hydrotreating and hydrocracking catalyst. The feedstock is substantially desulfurized and denitrified, the aromatics are at least partially saturated and cracked products are formed. The vapor and liquid are separated in a disengaging zone below the top section and the liquid flows down through a bottom section also containing a layered catalyst system countercurrent to make-up hydrogen flowing up. The vapor removed from the disengaging zone and the liquid bottoms are then further processed in a post treatment catalytic distillation reactor having an upper catalytic distillation section and a lower stripping section which may also contain a catalyst. Hydrogen for recycle and hydrogen sulfide and ammonia are removed from the post treatment reactor vapors leaving the product distillates.

According to US 2003/111386 A1, high conversion of heavy gas oils and the production of high quality products is possible in a single high-pressure loop with reaction stages, that operate at different pressure and conversion levels. The flexibility offered is great and will allow the refiner to avoid decrease in product quality while at the same time minimizing capital cost. Feeds with varying boiling ranges can be introduced at different sections of the process, thereby minimizing the consumption of hydrogen and further reducing capital investment.

The present invention is based on the idea of using a co-current reactor system, for instance the one described by the Applicant in WO 2012/172065 A1, for hydrotreating refinery fuel gases with an olefin level of 4 to 15%.

More particularly, Applicant's WO 2012/172065 describes a method and a reactor for performing exothermic catalytic reactions. The method comprises the steps of providing a feed gas stream comprising reactants for the exothermic catalytic reaction to a fixed-bed catalytic reactor. The reactor comprises one or more catalytic beds, each having sections filled with catalyst particles, and a feed gas bypass provided inside the reactor by arranging a number of bypass passageways having a cooling area without catalytically active particles within at least one of the catalyst beds.

A part of the feed gas stream is passed through the bypass passageways, and the rest of the feed gas stream is passed through the sections filled with catalyst particles. The heat is removed from the feed gas stream, which is passed through the sections filled with catalyst particles, by indirect heat transfer to the feed gas stream being passed through the bypass passageways.

Specifically, the present invention concerns a process for the hydrotreatment of a fuel gas stream containing up to 15% olefins, comprising the steps of:

- introducing the fuel gas stream into at least one co-current reactor, where the stream is split into two flow fractions, of which one fraction is routed through reactor sections containing catalysts active in olefin treatment, whereby the olefins are saturated to alkanes by hydrogenation, while the other fraction is routed through other reactor sections containing no active catalysts,
- subjecting the sections of active catalysts and the sections without active catalysts to heat exchange through pipe walls, metal sheeting or other forms of separation of the two section types,
- combining the two flows, thereby equalizing temperatures and compositions,
- cooling the combined flow over a heat exchanger, and finally
- reacting the combined flow to equilibrium in an adiabatic hydrotreatment reactor.

By heat exchanging through pipe walls, metal sheeting or other forms of separation of the two section types, the temperature increase will be significantly lower than it would have been in an adiabatic reactor.

If the fuel gas stream contains more than 8% olefins, a second co-current reactor with intercooling will be required. This second co-current reactor is arranged in series after the first co-current reactor and before the final adiabatic reactor.

Cooling between the reactors can be achieved by an intercooler with e.g. water, air or oil, separated from the product gas.

The intercooler between individual reactors can be replaced by a quench stream of water or gases. In principle, quenching between reactors can be achieved with water or any gas, e.g. hydrogen, carbon dioxide and/or nitrogen. Cold feed gas can also be used as quench gas, and this is a preferred option.

In one embodiment of the invention, with olefin levels of approximately 5-10%, a co-current reactor is designed and adjusted to hydrotreat only a portion of the feed gas olefins, as some of the feed gas passes through sections without active catalyst. The unreacted feed gas flows in parallel (i.e. co-current) to the reacted gas and exchanges heat with the reacted gas through a metal wall, which typically is a pipe or a flat surface. This way, the temperature of the reacted gas is reduced.

After the reactor, the reacted and the unreacted streams are combined, cooled and routed through a final adiabatic reactor. At this stage, full conversion to equilibrium has taken place, and the completely reacted product can be transferred to downstream units.

In another embodiment of the invention, with olefin levels of approximately 10-15%, a secondary co-current reactor is inserted after the first co-current reactor, such that the complete unit consists of two co-current reactors and one adiabatic reactor, with cooling inserted between the reactors.

The present once-through reactor solution to hydrotreatment of highly olefinic refinery fuel gas streams, which is both technically novel and innovative, presents very significant advantages in CAPEX. Thus, compared to a recycle system, there is no need for a recycle compressor, valves, pipes and control system, and the main reactors, valves and pipes can be smaller, since they do not need to carry the recycle flow.

Also from an OPEX perspective, the advantages are significant. The often substantial electric power needed for the compressor is eliminated, and so is maintenance of the recycle compressor and system, i.e. valves and pipes. The hydrotreatment catalyst cost will also be reduced, as the lifetime-influencing flow is reduced.

The invention claimed is:

1. A process for the hydrotreatment of a fuel gas stream containing up to 15% olefins, comprising the steps of:

- introducing the fuel gas stream into at least one co-current reactor, where the stream is split into two flow fractions, of which one fraction is routed through reactor sections containing catalysts active in olefin treatment, whereby the olefins are saturated to alkanes by hydrogenation, while the other fraction is routed through other reactor sections containing no active catalysts,
- subjecting the sections of active catalysts and the sections without active catalysts to heat exchange through pipe walls, metal sheeting or other forms of separation of the two section types,
- combining the two flows, thereby equalizing temperatures and compositions,
- cooling the combined flow over a heat exchanger, and finally
- reacting the combined flow to equilibrium in an adiabatic hydrotreatment reactor.

2. Process according to claim 1, wherein the fuel gas stream contains more than 8% olefins, requiring a second co-current reactor with an intercooler arranged in series after the first co-current reactor and before the final adiabatic reactor.

3. Process according to claim 2, wherein the intercooler between individual reactors is replaced by a quench stream.

4. Process according to claim 3, wherein cold feed gas is used as quench stream.

5. Process according to claim 3, wherein the quench stream comprises one or more of hydrogen, water, carbon dioxide and nitrogen.

* * * * *